US011612805B2

(12) United States Patent
Botta et al.

(10) Patent No.: US 11,612,805 B2
(45) Date of Patent: Mar. 28, 2023

(54) SYSTEM AND METHOD FOR AN INTERACTIVE BOARD GAME

(71) Applicant: WIZAMA, Chateaugiron (FR)

(72) Inventors: Franck Botta, Osse (FR); Florent Guitton, Amanlis (FR)

(73) Assignee: WIZAMA, Chateaugiron (FR)

( * ) Notice: Subject to any disclaimer, the term of this patent is extended or adjusted under 35 U.S.C. 154(b) by 97 days.

(21) Appl. No.: 16/966,522

(22) PCT Filed: Jan. 30, 2019

(86) PCT No.: PCT/EP2019/052206
§ 371 (c)(1),
(2) Date: Jul. 31, 2020

(87) PCT Pub. No.: WO2019/149732
PCT Pub. Date: Aug. 8, 2019

(65) Prior Publication Data

US 2021/0052972 A1 Feb. 25, 2021

(30) Foreign Application Priority Data

Feb. 2, 2018 (FR) ..... 1850902

(51) Int. Cl.
*A63F 3/00* (2006.01)
*A63F 1/04* (2006.01)
(Continued)

(52) U.S. Cl.
CPC ..... *A63F 3/00643* (2013.01); *A63F 1/04* (2013.01); *A63F 9/0415* (2013.01);
(Continued)

(58) Field of Classification Search
CPC ..... A63F 3/00643; A63F 1/04; A63F 9/0415; A63F 2003/00662; A63F 2009/241; A63F 2009/2489
See application file for complete search history.

(56) References Cited

U.S. PATENT DOCUMENTS

2012/0052934 A1* 3/2012 Maharbiz ..... A63F 13/98 463/9
2012/0100901 A1 4/2012 Kirsch
2014/0094312 A1 4/2014 Wouhaybi et al.

FOREIGN PATENT DOCUMENTS

EP 1892683 A1 2/2008
EP 3001287 3/2016
(Continued)

OTHER PUBLICATIONS

International Search Report and Written Opinion in Corresponding PCT Application No. PCT/EP2019/052206 dated Nov. 4, 2019. 11 pages.

*Primary Examiner* — William H McCulloch, Jr.
*Assistant Examiner* — Ankit B Doshi
(74) *Attorney, Agent, or Firm* — Leason Ellis LLP

(57) ABSTRACT

The present invention relates to an interactive board game system and method composed of game equipment. The present invention further comprises a board game management device (PL) having a touch screen (Ec) comprising a plurality of antennas, several antennas (Ant1*a*, Ant1*b*, Ant1*c* to Ant8*a*, Ant8*b*, Ant8*c*) disposed at the periphery of the board game management device, each item of game equipment (Ca1, Ca2, Ca3, Ca4, Ca5, Ca6, P1, P2, P3, P4, De) comprises at least one radio-identification tag that is activated by an antenna of the board game management device when the equipment is in a zone comprising the antenna and which in response delivers a signal received by the antenna and transferred to the board game management device, and
(Continued)

the board game management device comprises a means (Ce) for displaying information to the players of the board game that changes according to the placement of the game equipment on the screen or in the vicinity of the antennas disposed at the periphery.

8 Claims, 4 Drawing Sheets

(51) Int. Cl.
*A63F 9/04* (2006.01)
*A63F 9/24* (2006.01)

(52) U.S. Cl.
CPC ..... *A63F 2003/00662* (2013.01); *A63F 2009/241* (2013.01); *A63F 2009/2489* (2013.01)

(56) References Cited

FOREIGN PATENT DOCUMENTS

| | | | |
|---|---|---|---|
| FR | 2929432 | A1 | 10/2009 |
| WO | 2009111829 | A1 | 9/2009 |
| WO | 2014072622 | A1 | 5/2014 |
| WO | 2016155887 | A1 | 10/2016 |

* cited by examiner

SYSTEM AND METHOD FOR AN INTERACTIVE BOARD GAME

CROSS-REFERENCE TO RELATED PATENT APPLICATIONS

This application is a U.S. National Stage Application under 35 U.S.C. § 371 of International Patent Application No. PCT/EP2019/052206, filed January 30, 2019, which claims the benefit of priority of French Patent Application number 1850902 filed Feb. 2, 2018, both of which are incorporated by reference in their entireties. The International Application was published on Aug. 8, 2019, as International Publication No. WO 2019/149732 A1.

The present invention relates to an interactive board game method and system.

Board games are non-sporting, are played with a plurality of people, generally indoors, and usually use equipment especially manufactured for this game.

The equipment consists for example of cards, a game board, dice, pieces, supports, etc.

A board game enthusiast must, if he wishes to vary his pleasure, or adapt the choice of game according to the wishes of his partners, have available a large number of board games. New board games regularly appear and quite often the board game enthusiast does not have the game that he would wish to discover at a given moment.

The aim of the present invention is to solve the drawbacks of the prior art by proposing an interactive board game method and system that makes it possible to play a great diversity of board games.

To this end, according to a first aspect, the invention proposes an interactive board game system composed of game equipment, characterised in that the system further comprises a board game management device having a touch screen comprising a plurality of antennas, several antennas disposed at the periphery of the board game management device, each item of game equipment comprises at least one radio-identification tag that is activated by an antenna of the board game management device when the equipment is in a zone comprising the antenna and which in response delivers a signal received by the antenna and transferred to the board game management device, and the board game management device comprises a means for displaying information intended for the players of the board game that changes according to the placement of the game equipment on the screen or in the vicinity of the antennas disposed at the periphery.

The present invention also relates to a game method in an interactive board game system composed of game equipment, characterised in that the system further comprises a board game management device having a touch screen comprising a plurality of antennas, several antennas disposed at the periphery of the board game management device, each item of game equipment comprises at least one radio-identification tag that is activated by an antenna of the board game management device when the equipment is in a zone comprising the antenna and which in response delivers a signal received by the antenna and transferred to the board game management device, and in that the method comprises the steps of:

- detecting the placement of the game equipment on the screen or in the vicinity of the antennas disposed at the periphery,
- displaying information intended for the players of the board game that changes according to the placement of the game equipment on the screen or in the vicinity of the antennas disposed at the periphery.

Thus the game management device at all times detects the position of the game equipment and makes it possible to run the board game, and to change the display of information. The game system replaces a large quantity of board games, provides interactivity, adapts to the actions of the players, improves immersion in the game by displaying videos, is adapted to the age and knowledge of the players, and can provide a tutorial. A catalogue of games can be accessible at any time.

According to a particular embodiment of the invention, the equipment comprises at least one dice and a radio-identification tag that is disposed on each face of the dice, each radio-identification tag identifying the face of the dice.

Thus the game system allows the use of dice and allows automatic detection of the face of the dice.

According to a particular embodiment of the invention, on each face of the dice an electromagnetic screen is disposed for limiting the direction in which the radio-identification tag is activated by an antenna.

Thus the present invention does not need to use technologies based on the use of a gyroscope that are expensive. The present invention uses, if needed, electromagnetic screens such as ferrites adapted to the power of transmission of the electromagnetic waves by the antennas.

According to a particular embodiment of the invention, the system further comprises a dice run comprising a plurality of antennas.

Thus the present invention avoids the dice being thrown onto the game management device.

It should be remarked here that, in a particular embodiment of the present invention, the dice run is conical in form, thus limiting the number of antennas, and the antennas of the dice run are placed on first and second layers, the antennas of the first layer being offset with respect to the antennas of the second layer so as to guarantee that no non-detection zone exists on the dice run.

Thus the present invention avoids the dice being thrown onto the game management device.

According to a particular embodiment of the invention, the equipment comprises a plurality of cards, and each card comprises at least two radio-identification tags and an electromagnetic screen associated with a tag preventing the radio-identification tag that is associated therewith being activated by an antenna of the board game management device when the card is disposed on a predetermined face.

According to a particular embodiment of the invention, the equipment comprises a plurality of cards, and each card comprises at least two radio-identification tags disposed on ends of the card in order to identify the directional orientation of the card.

Thus the present invention makes it possible to recognise which face of a card is presented during the game. The present invention thus makes it possible to be compatible with a large number of board games.

According to a particular embodiment of the invention, the equipment comprises a plurality of pieces and each piece further comprises conductive elements to allow detection of the piece by capacitive effect on the screen of the board game management device.

Thus it is possible to precisely detect the position of the piece on the touch screen by capacitive effect and to identify the piece by means of the radio-identification tag when it is disposed or placed by the player.

According to a particular embodiment of the invention, the board game management device detects the position of each player around the board game management device when the piece is placed in the vicinity of an antenna disposed at the periphery of the board game management device.

Thus the present invention makes it possible to determine the position of each player automatically and simply.

According to a particular embodiment of the invention, the board game management device detects each card placed by a player when it is placed in the zone in the vicinity of the antenna that has detected the piece of the player.

Thus the present invention makes it possible to automatically and simply determine which card is placed and which player has placed it.

According to a particular embodiment of the invention, the means for displaying information intended for the players of the game displays messages for each player in a zone and an orientation corresponding to the detected position of the player.

Thus the man-machine interface is user friendly and practical for the players.

The invention also relates to the computer programs stored on an information carrier, said programs containing instructions for implementing the methods described above, when they are loaded into and executed by a computer system.

The features of the invention mentioned above, as well as others, will emerge more clearly from a reading of the following description of an example embodiment, said description being given in relation to the accompanying drawings, among which:

Figure 6A:
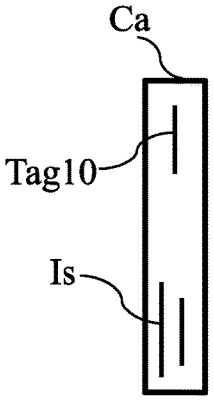
Figure 6B:
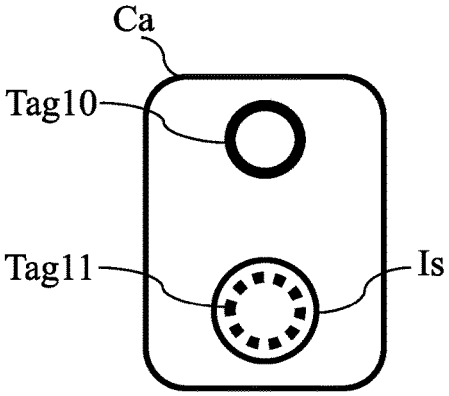
Figure 7:
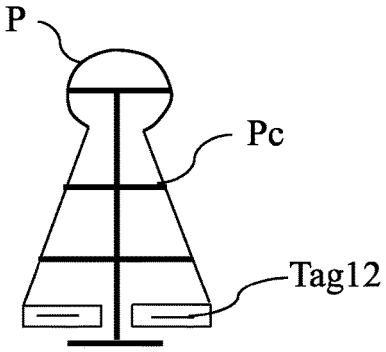
Figure 8:
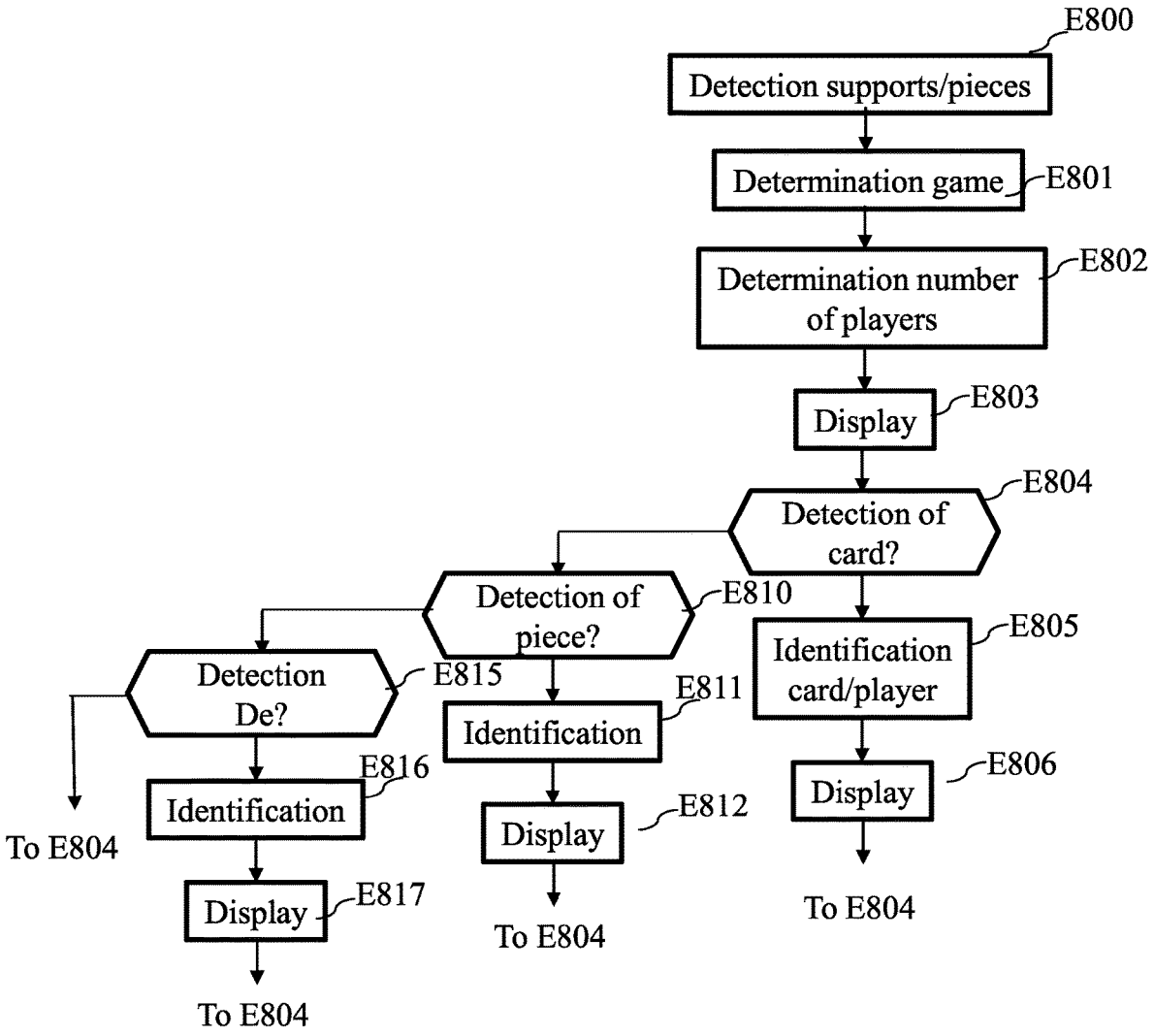

FIG. 6*a* depicts a cross section of a card according to the present invention;

FIG. 6*b* depicts a view on a face of a card according to the present invention;

FIG. 7 depicts an example embodiment of a piece according to the present invention;

FIG. 8 depicts an example of an algorithm executed by the game management device according to the present invention.

Figure 1:
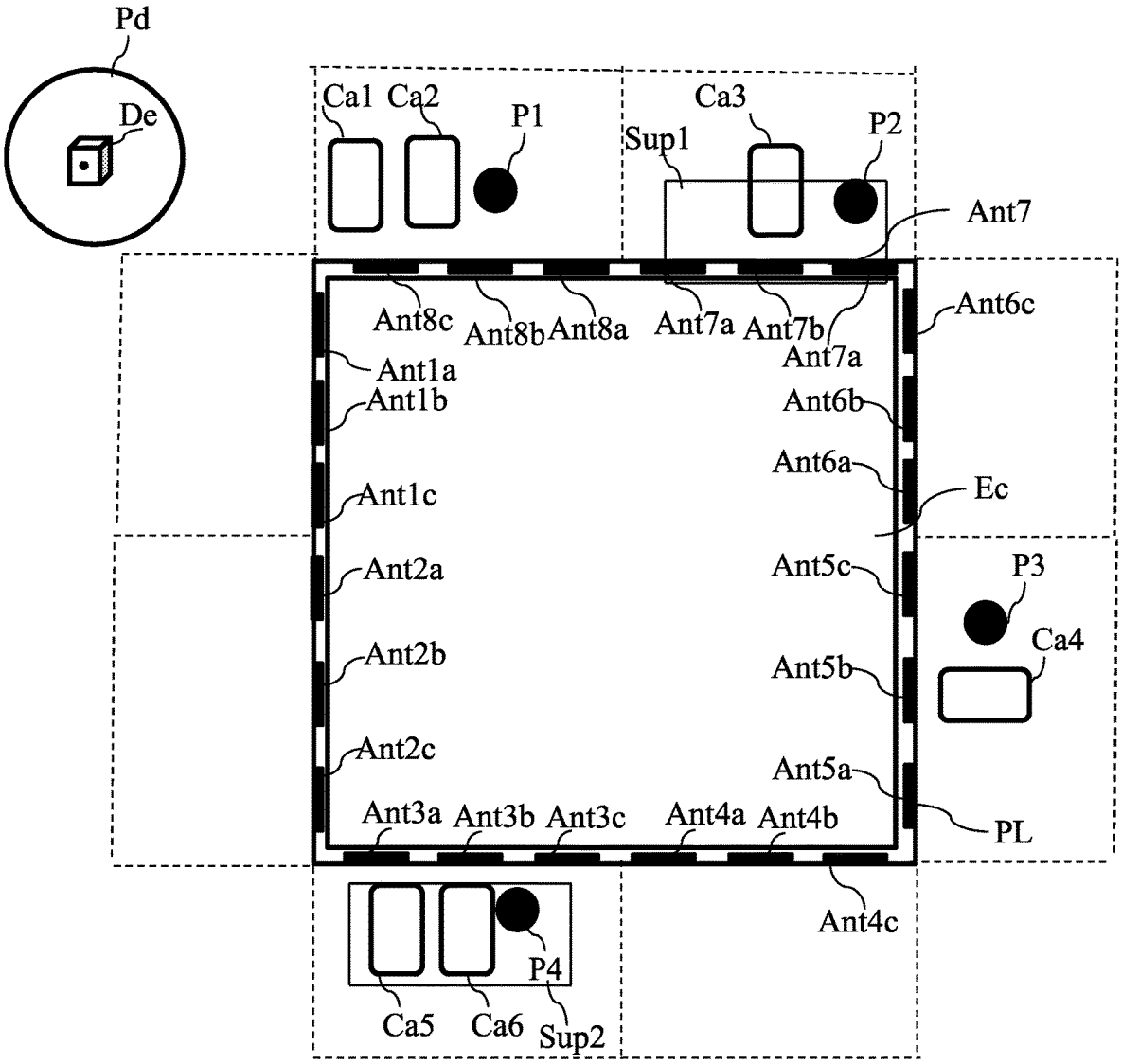
FIG. 1 depicts an interactive board game system according to the present invention.

FIG. 1 depicts an interactive board game system according to the present invention.

The interactive board game system consists of a board game management device PL, pieces P1 to P4, at least one dice De, cards Ca1 to Ca6 and a dice baize or dice run Pd.

The board game management device PL comprises a touch screen Ec on which a plurality of antennas are disposed, not depicted in FIG. 1, and a plurality of antennas Ant1 to Ant8 disposed at the periphery, more particularly on the sides of the board game management device PL. The antennas are compatible with NFC/RFID (Near Field Communication/Radio-Frequency Identification) technology.

Radio-frequency identification, usually designated by the acronym RFID, is a method for storing and recovering data remotely using markers known as "radio tags" (RFID tags or RFID transponders) allowing identification.

The pieces P1 to P3, the cards Ca1 to Ca6, and the dice De comprise at least one RFID tag. The RFID tags are small objects, which can be bonded to or incorporated in objects. The RFID tags comprise an antenna associated with an electronic chip that enables them to receive and respond to radio requests sent from the transceiver.

These electronic chips contain an identifier and optionally supplementary data.

Each piece P1 to P3 further comprises conductive elements to allow detection of the piece by capacitive effect on the screen Ec of the board game management device P1.

The dice De comprises a radio-identification tag that is disposed on each face of the dice, each radio-identification tag identifying the face of the dice. On each face of the dice there is disposed an electromagnetic screen such as a ferrite for limiting the direction along which the radio-identification tag is activated by an antenna.

The system comprises a dice run Pd comprising a plurality of antennas.

It should be noted here that, in a particular embodiment of the present invention, the dice run is conical in form, thus limiting the number of antennas, and the antennas of the dice run are placed on first and second layers, the antennas of the first layer being offset with respect to the antennas of the second layer so as to guarantee that no non-detection zone exists on the dice run.

Each card Ca1 to Ca6 comprises at least two tags and a screen associated with a tag preventing the radio-identification tag that is associated therewith from being activated by an antenna of the board game management device when the card is disposed on a predetermined face.

At the start of the game, each player places a piece opposite at least one antenna, for example three antennas, Ant1*a*, Ant1*b*, Ant1*c* to Ant8*a*, Ant8*b*, Ant8*c* placed at the periphery of the board game management device PL. The board game management device PL thus identifies the number of players and the position of the player having the piece. During the progress of the game, each card Ca1 to Ca6 placed at the periphery, depicted in hatched lines, of an antenna Ant1 to Ant8 will be identified and will make it possible to identify the player who has placed it.

When a piece is placed or moved on the touch screen by a player, the position thereof is determined precisely by the touch screen and the identifier thereof is determined by an antenna of the screen Ec.

When a card is placed or moved on the touch screen, this is identified by an antenna of the screen Ec.

In a variant, supports Sup1, Sup2 are placed on top of or at the periphery of the antennas Ant1*a*, Ant1*b*, Ant1*c* to Ant8*a*, Ant8*b*, Ant8*c*. The supports comprise at least one radio-identification tag identifying the board game played from among a plurality of board games. The tag is activated by an antenna and in response delivers a signal received by the antenna and transferred to the board game management device that enables the board game management device to identify, from a plurality of board games, the board game to be played, from the signal transmitted by the radio-identification tag of the support.

Figure 2:
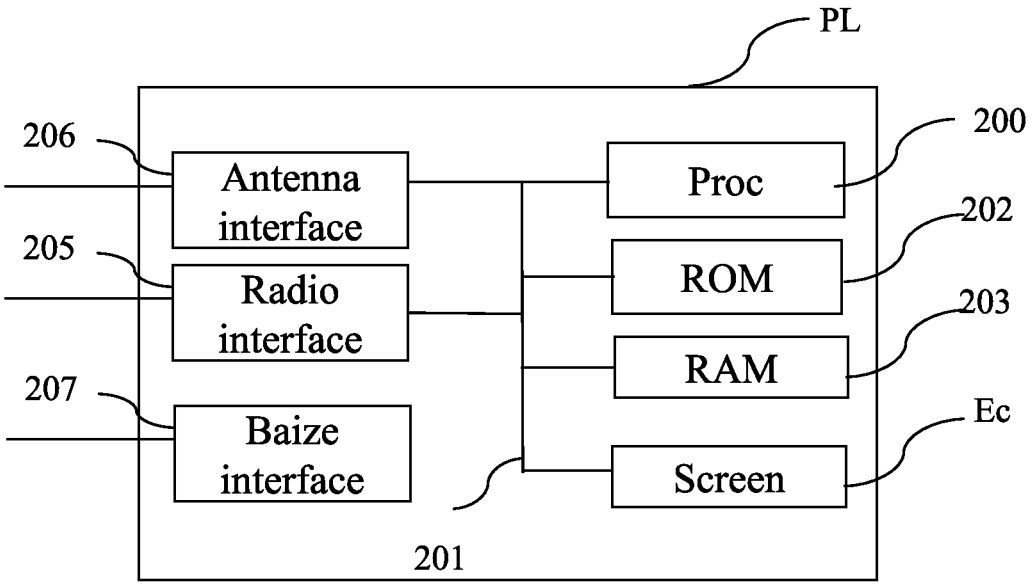
FIG. 2 depicts an example of architecture of a game management device according to the present invention.

FIG. 2 depicts an example of architecture of a game management device according to the present invention.

The board game management device PL comprises:

a processor, microprocessor or microcontroller 200;

a volatile memory 203;

a non-volatile memory 202;

a touch screen Ec;

an interface to a network 205, for example of the radio type;

an interface 206 with the antennas at the periphery of and/or disposed under the touch screen of the board game management device PL;

an interface 207 with the dice run Td;

a communication bus 201 connecting the processor 200 to the ROM memory 202, to the RAM memory 203, to the interface to a first network 205; to the interfaces 206 and 207 and to the touch screen Ec.

The processor 200 is capable of executing instructions loaded in the volatile memory 203 from the non-volatile memory 202, from an external memory (not shown), from a storage medium such as an SD card or the like, or from a communication network. When the board game management device PL is powered up, the processor 200 is capable of reading instructions from the volatile memory 203 and executing them. These instructions form a computer program that causes the implementation, by the processor 200, of part of the method according to the present invention.

All or part of the method can be implemented in software form by the execution of a set of instructions by a programmable machine such as a DSP (digital signal processor) or a microcontroller or be implemented in hardware form by a machine or a dedicated component, such as an FPGA (field-programmable gate array) or an ASIC (application-specific integrated circuit).

The interface to the network 205 is for example a communication interface to a cellular network or of the internet type.

Figure 3:
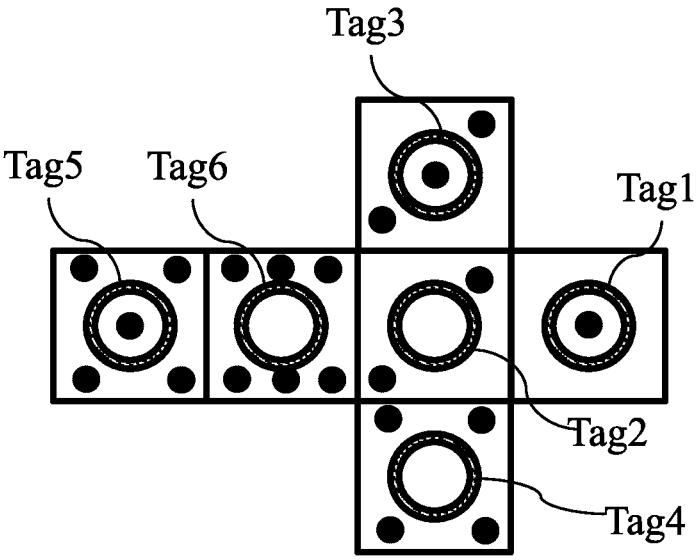
FIG. 3 depicts a first view of a dice according to the present invention.

FIG. 3 depicts a first view of a dice according to the present invention.

The dice De is essentially made from plastic. Each face of the dice includes an RFID tag denoted Tag1 to Tag6, and an electromagnetic screen such as a ferrite sheet for isolating each of the faces from one another. When one of the faces of the dice is in contact with the dice run Pd, it is detected and this information is interpreted by the board game management device PL.

Figure 4:
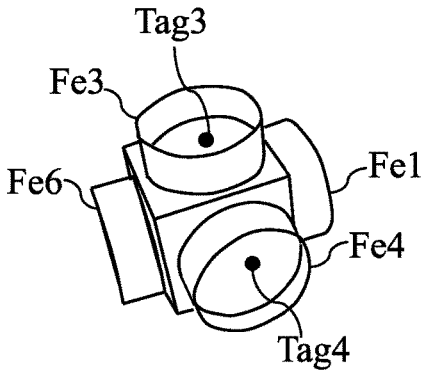
FIG. 4 depicts a second view of a dice according to the present invention.

FIG. 4 depicts a second view of a dice according to the present invention.

The second view depicts the ferrites disposed on each face of the dice in order to limit the direction along which the radio-identification tag is activated by an antenna.

The ferrite Fe3 limits the direction along which the radio-identification tag Tag3 is activated.

The ferrite Fe4 limits the direction along which the radio-identification tag Tag4 is activated. The ferrites have an orientation and a size, for example cylindrical or conical, adapted to the power of the electromagnetic field of the antennas of the dice run Pd.

Only the face of the dice in the orientation of the magnetic field is detected, which makes it possible by deduction to know the value indicated on the opposite face.

Figure 5:
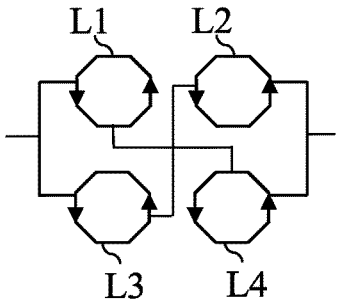
FIG. 5 depicts an arrangement of antennas in the dice run according to the present invention.

FIG. 5 shows an arrangement of antennas in the dice run according to the present invention.

The dice run Pd is connected to the game management device Pe. It has, in the example in FIG. 5, a conical shape so as to favour stabilisation of the dice on a predetermined surface, more precisely at the centre thereof, on which a plurality of antennas are disposed.

Thus the surface that has to be covered by the antennas is limited while offering a large surface area for the run.

The plurality of antennas are produced for example in an array of four antennas L1, L2, L3 and L4 so as best to distribute the electromagnetic field and to reduce the electrical consumption.

The antennas L1 to L4 are connected together in a series-parallel circuit optimising the direction of the electric current, as shown in FIG. 5.

FIG. 6 show a card according to the present invention.

The card Ca comprises two radio-identification tags Tag10 and Tag11.

The radio-identification tag Tag10 is able to be activated by an antenna whatever the face on which the card Ca is disposed.

The radio-identification tag Tag11 is able to be activated by an antenna only when the electromagnetic screen Is is not situated between an antenna Ant and a radio-identification tag Tag11.

This same principle can be extended to cards of various forms, for example round, triangular, square, etc.

In a particular embodiment, each face may comprise at least two radio-frequency tags so as to make it possible to identify the orientation of the card.

FIG. 7 shows an example embodiment of a piece according to the present invention.

Each piece P1 to P4 comprises a radio-frequency tag denoted Tag12 and contact points that are electrical conductors that make it possible to detect a change in the capacitance at the point of contact of the piece P with the touch screen Ec when the player places the piece on the touch screen.

In a variant, the contact point is provided by an electrically conductive layer disposed on the part of the piece that the player touches.

FIG. 8 shows an example of an algorithm executed by the game management device according to the present invention.

The present algorithm is described in an example in which it is executed by the processor 200 of the game management device.

At the step E800, the processor 200 detects, by means of the touch screen Ec or antennas, the placement of the pieces P1 to P4 or of the supports in the vicinity of the antennas Ant1*a*, Ant1*b*, Ant1*c* to Ant8*a*, Ant8*b*, Ant8*c*.

From the support identifiers, the processor 200 determines the game that must be played at the step E801. If the information necessary for the playing of the board game is not present in the RAM memory 203, the processor 200 obtains the information from a remote server by means of the radio interface 206.

At the step E802, the processor 200 determines the number of players by counting the number of supports or pieces placed in the vicinity of the antennas Ant1 to Ant8.

At the step E803, the processor 200 commands the display of a message to the players.

At the step E804, the processor 200 checks whether at least one card is placed in the vicinity of the antennas Ant1*a*, Ant1*b*, Ant1*c* to Ant8*a*, Ant8*b*, Ant8*c* or on the game management device by means of the antenna interface 206.

If at least one card is placed in the vicinity of the antennas Ant1*a*, Ant1*b*, Ant1*c* to Ant8*a*, Ant8*b*, Ant8*c* or on the game management device, the processor 200 passes to the step E805. If not, the processor 200 passes to the step E810.

At the step E805, the processor 200 identifies the card and the player who has placed the card by identifying the antenna Ant in the vicinity thereof or according to the order in which the players are playing.

At the step E806, the processor 200 commands the display of a message to the players.

Once this operation has been performed, the processor 200 returns to the step E804.

If the test performed at the step E804 is negative, the processor 200 passes to the step E810.

At the step E810, the processor 200 checks whether at least one piece is placed or moved on the screen of the game management device PL by means of the antenna interface 206 and the touch screen.

If at least one piece is placed or moved, the processor 200 passes to the step E811. If not, the processor 200 passes to the step E415.

At the step E811, the processor 200 identifies the piece, the position thereof and the player who placed or moved the piece.

At the step E812, the processor 200 commands the display of a message to the players.

Once this operation has been performed, the processor 200 returns to the step E804.

If the tests performed at the steps E804 to E810 are negative, the processor 200 passes to the step E815.

At the step E815, the processor 200 checks whether at least one dice has been thrown onto the dice run Pd.

If at least one dice has been thrown, the processor 200 passes to the step E816. If not, the processor 200 returns to the step E804.

At the step E816, the processor 200 identifies the top face of the dice by deduction from the identification of the bottom face.

At the step E817, the processor 200 demands the display of a message to the players.

Once this operation has been performed, the processor 200 returns to the step E804.

Naturally the present invention is in no way limited to the embodiments described here but quite the contrary encompasses any variant within the capability of a person skilled in the art.

The invention claimed is:

1. An interactive board game system composed of game equipment, wherein the system further comprises a board game management device (PL) having a touch screen (Ec) comprising a plurality of antennas, each item of game equipment comprises at least one radio-identification tag that is activated by an antenna of the board game management device when the equipment is in a zone comprising the antenna and which in response delivers a signal received by the antenna and transferred to the board game management device, and the board game management device comprises a means for displaying information intended for the players of the board game that changes according to the placement of the game equipment on the screen or in the vicinity of the antennas, wherein the board game management device (PL) further comprises a plurality of antennas disposed at the periphery of the board game management device in order to identify the game equipment, during the game, facing at least one antenna disposed at the periphery of the board game management device, wherein the equipment comprises at least one dice and in that a radio-identification tag and an electromagnetic screen is disposed on each face of the dice, each radio-identification tag identifying the face of the dice, and each electromagnetic screen is disposed for limiting the direction in which the radio- identification tag is activated by an antenna.

2. The interactive board game system according to claim 1, wherein the system further comprises a dice run comprising a plurality of antennas.

3. The interactive board game system according to claim 1, wherein the equipment comprises a plurality of cards, each card comprises at least two tags and a screen associated with a tag preventing the radio-identification tag that is associated therewith from being activated by an antenna of the board game management device when the card is disposed on a predetermined face.

4. The interactive board game system according to claim 1, wherein the equipment comprises a plurality of pieces and in that each piece further comprises conductive elements to allow detection of the piece by capacitive effect on the screen of the board game management device.

5. The interactive board game system according to claim 4, wherein the board game management device detects the position of each player around the board game management device when the piece is placed in the vicinity of an antenna disposed at the periphery of the board game management device.

6. The interactive board game system according to claim 3, wherein the board game management device detects each card placed by a player when it is placed in the zone in the vicinity of the antenna that detected the piece of the player.

7. The interactive board game system according to claim 5, wherein the means for displaying information for the players of the game displays messages to each player in a zone and an orientation corresponding to the detected position of the player.

8. A playing method in an interactive board game system composed of game equipment, wherein the system further comprises a board game management device having a touch screen comprising a plurality of antennas, each item of game equipment comprises at least one radio-identification tag that is activated by an antenna of the board game management device when the equipment is in a zone comprising the antenna and which in response delivers a signal received by the antenna and transferred to the board game management device, wherein the board game management device (PL) further comprises a plurality of antennas disposed at the periphery of the board game management device, and the method comprises the steps of:

detecting the placement of the game equipment on the screen, detecting, during the game, the placement of the game equipment opposite at least one antenna disposed at the periphery of the board game management device, display of the information to the players of the board game that changes according to the placement of the game equipment on the screen or opposite to at least one antenna disposed at the periphery of the management device, wherein the game equipment comprises at least one dice and in that a radio-identification tag and an electromagnetic screen is disposed on each face of the dice, each radio-identification tag identifying the face of the dice, and each electromagnetic screen is disposed for limiting the direction in which the radio- identification tag is activated by an antenna.

* * * * *